US008020253B1

(12) United States Patent
Finkelstein et al.

(10) Patent No.: US 8,020,253 B1
(45) Date of Patent: Sep. 20, 2011

(54) HINGE AND HINGE COVER

(75) Inventors: Burl M. Finkelstein, Newnan, GA (US); Brett A. Mitchell, Newnan, GA (US); Thomas A. Thorsen, Wedowee, AL (US)

(73) Assignee: Kason Industries, Inc., Newnan ( * ) Notice: Subject to any disclaimer, the term of this patent is extended or adjusted under 35 U.S.C. 154(b) by 760 days.

(21) Appl. No.: 11/865,234

(22) Filed: Oct. 1, 2007

Related U.S. Application Data

(63) Continuation-in-part of application No. 11/850,126, filed on Sep. 5, 2007, now Pat. No. 7,584,523, and a continuation-in-part of application No. 11/850,145, filed on Sep. 5, 2007, now Pat. No. 7,870,642.

(51) Int. Cl.
*E05D 11/00* (2006.01)

(52) U.S. Cl. ..... 16/250

(58) Field of Classification Search ..... 16/235, 16/245–247, 250–251, 260; 312/326; 49/398
See application file for complete search history.

(56) References Cited

U.S. PATENT DOCUMENTS

| | | | | | |
|---|---|---|---|---|---|
| 2,027,888 | A | | 1/1936 | Solomon | |
| 2,169,059 | A | * | 8/1939 | Soss et al. | 16/251 |
| 2,581,104 | A | | 1/1952 | Houlsby, Jr. | |
| 2,615,194 | A | | 10/1952 | Kreiner | |
| 3,626,548 | A | | 12/1971 | Grunert | |
| 3,866,658 | A | | 2/1975 | Smith | |
| 4,156,301 | A | | 5/1979 | Schneider et al. | |
| D255,868 | S | | 7/1980 | Berkowitz et al. | |
| 4,407,044 | A | | 10/1983 | Iseki | |
| 4,870,716 | A | * | 10/1989 | Grass | 16/251 |
| 4,991,259 | A | | 2/1991 | Finkelstein et al. | |
| 5,056,192 | A | * | 10/1991 | Grass | 16/251 |
| 5,218,739 | A | | 6/1993 | Lautenschlager | |
| 5,224,240 | A | * | 7/1993 | Smith et al. | 16/251 |
| 5,432,979 | A | * | 7/1995 | Harper | 16/251 |
| 5,490,306 | A | * | 2/1996 | Floyd et al. | 16/250 |
| 5,491,930 | A | | 2/1996 | La See | |
| D395,590 | S | | 6/1998 | Finkelstein | |
| D401,134 | S | | 11/1998 | Finkelstein | |
| 6,049,946 | A | | 4/2000 | Cress et al. | |
| 6,070,294 | A | * | 6/2000 | Perkins et al. | 16/252 |
| 6,152,554 | A | | 11/2000 | Parisi | |
| 6,202,255 | B1 | | 3/2001 | Sitter | |
| 6,374,458 | B1 | | 4/2002 | Finkelstein | |
| 7,055,214 | B1 | | 6/2006 | Finkelstein | |
| 7,178,197 | B2 | * | 2/2007 | Verheye, Sr. | 16/250 |
| 7,584,523 | B1 | * | 9/2009 | Finkelstein et al. | 16/260 |
| 2010/0026155 | A1 | * | 2/2010 | Yun | 312/405 |

* cited by examiner

*Primary Examiner* — William L. Miller
(74) *Attorney, Agent, or Firm* — Baker Donelson; Dorian B. Kennedy

(57) ABSTRACT

There is disclosed a hinge (10) which includes a mounting flange assembly (12) pivotally coupled to a strap assembly (15). The mounting flange assembly includes a mounting flange (16) having four mounting holes (17) therethrough, a lower hinge barrel (18) extending from the mounting flange, and an upper hinge barrel (19) extending from the mounting flange. The strap assembly includes a strap (31) extending from a cylinder portion (32). The hinge also includes a main cover (57) covering the strap assembly, an upper flange cover (28) covering the upper hinge barrel, and a lower flange cover (29) covering the lower hinge barrel.

14 Claims, 3 Drawing Sheets

HINGE AND HINGE COVER

REFERENCE TO RELATED APPLICATIONS

This is a continuation-in-part of U.S. patent application Ser. No. 11/850,126 filed Sep. 5, 2007, U.S. Pat. No. 7,584,523, and U.S. patent application Ser. No. 11/850,145 filed Sep. 5, 2007, U.S. Pat. No. 7,870,642.

TECHNICAL FIELD

This invention relates generally to door hinges, and more particularly to hinges and hinge covers used for commercial refrigerator and freezer doors.

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit.

Accordingly, there is a need in the art for a hinge that will allow for easy cleaning and dismantling. It is to the provision of such therefore that the present invention is primarily directed.

SUMMARY OF THE INVENTION

In a preferred form of the invention a hinge comprises a flange assembly, a strap assembly pivotally coupled to the flange assembly wherein the strap assembly includes a strap and a cylinder portion coupled to the flange assembly. The hinge also includes a main cover removably mounted to the strap assembly. The cover overlays the strap and the cylinder portion.

DETAILED DESCRIPTION

Figure 1:
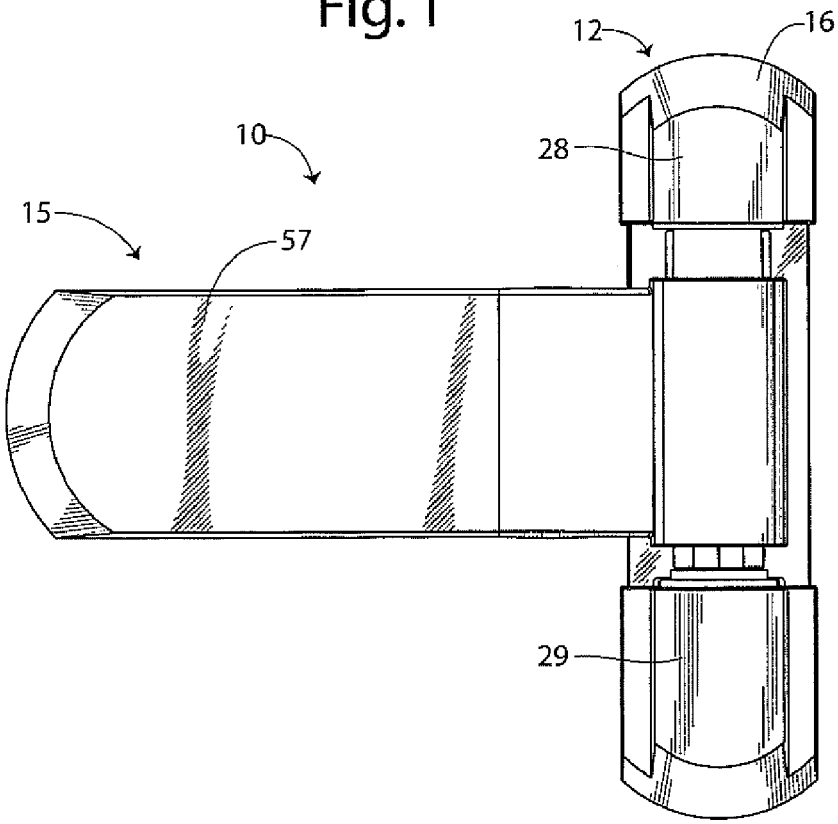
FIG. 1 is a front view of an anti-sag hinge embodying principles of the invention in a preferred form.
Figure 2:
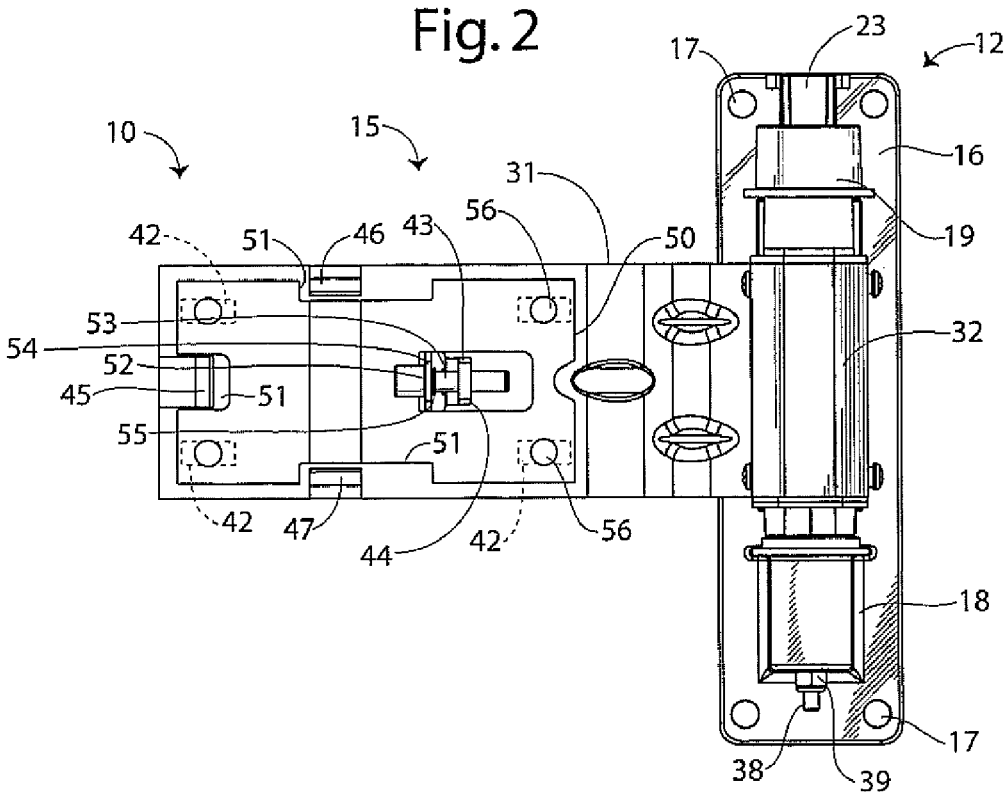
FIG. 2 is a front view of the anti-sag hinge of FIG. 1, shown with the covers removed.
Figure 3:
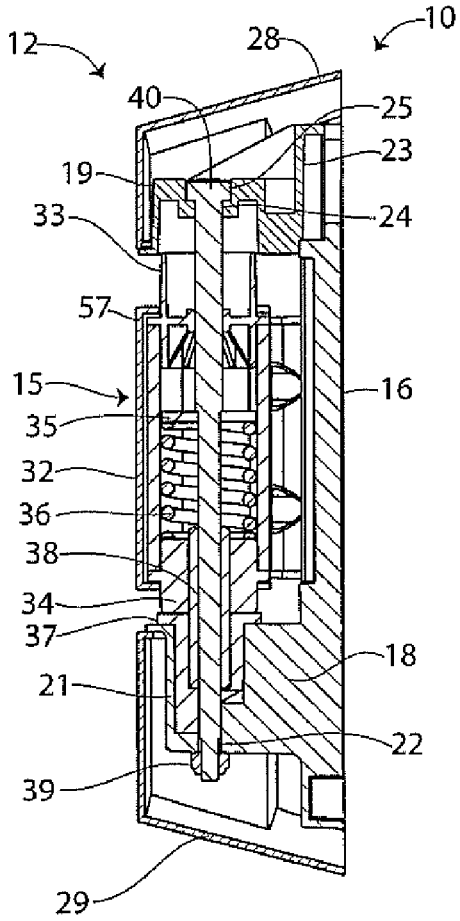
FIG. 3 is a cross-sectional side view of the anti-sag hinge of FIG. 1.
Figure 4:
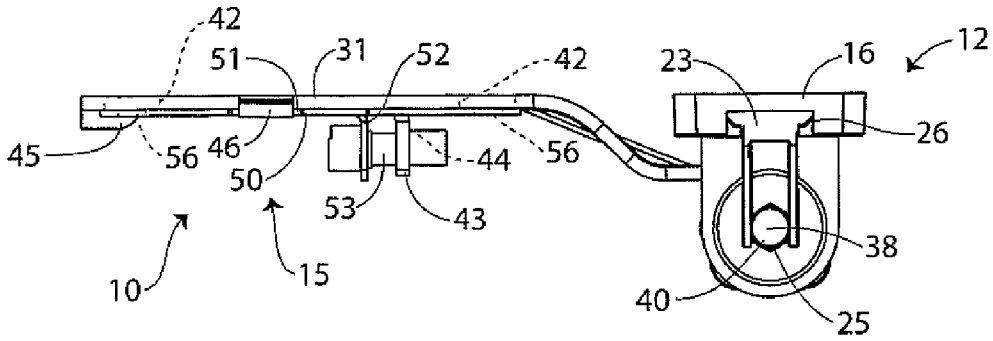
FIG. 4 is a top view of the anti-sag hinge of FIG. 1.

With reference next to the drawings, there is shown an anti-sag hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

The mounting flange assembly 12 includes a mounting flange 16 having four mounting holes 17 therethrough adapted to receiving unshown mounting bolts or screws, a lower hinge barrel 18 extending from the mounting flange 16, and a removably mated upper hinge barrel 19 extending from the mounting flange 16. The upper and lower hinge barrels provide for a dual or double shear system (two positions wherein a shearing force is provided between the strap assembly and the flange assembly 12) that provides a stable connection between the strap assembly 15 and the flange assembly 12. The lower hinge barrel 18 includes an internally mounted cam 21 which enables the hinge to be a riser type hinge, although this is merely an option of the present invention. The lower hinge barrel 18 also includes a shoulder bolt hole 22 therethrough. The upper hinge barrel 19 includes a dove-tail flange 23 and a shoulder bolt hole 24 therethrough which includes a countersunk hexagonal hole portion 25. The dove-tail flange is configured to removably mate with a tapered slot 26 extending from the top edge of the mounting flange 16. The mounting flange assembly 12 also includes a removable upper flange cover 28 configured to cover the upper hinge barrel 19 and a removable lower flange cover 29 configured to cover the lower hinge barrel 18. The covers 28 and 29 are provided for many reasons, including aesthetics and to meet the sanitary requirements employed in the industry as specified by the National Sanitation Foundation.

The strap assembly 15 includes a strap 31 extending from a cylinder portion 32. The term cylinder portion 32 is meant to describe the enlarged casing located at the end of the strap and the encased bearings, spring, and cam described in more detail hereinafter. The term cylinder portion is not intended to be limited to a cylinder shape, as this portion or parts of this portion may be of many known shapes and are not necessarily cylindrical in shape. The cylindrical portion 32 includes an upper strap bearing 33, a lower strap bearing 34, a thrust washer 35, a spring 36 mounted between the lower strap bearing 34 and the thrust washer 35, and a cam follower 37 configured to mate with cam 21. A shoulder bolt 38 extends through the upper hinge barrel mounting bolt hole 24, the upper strap bearing 33, the thrust washer 35, the spring 36, the lower strap bearing 34, the cam follower 37, the cam 21, and through the lower hinge barrel mounting bolt hole 22. A hex nut 39 is threaded onto the lower end of the shoulder bolt 38 while the head portion 40 of the shoulder bolt is configured to fit snugly within the hexagonal hole portion 25.

The strap 31 includes four elongated mounting holes 42, a screw adjustment flange 43 having a threaded screw hole 44 therein, an end guide 45, an upper guide 46 and a lower guide 47. The strap 31 also includes a moveable adjustment bracket 50 mounted for lateral movement relative to the underlying strap 31. The movement of the adjustment bracket 50 is limited by the end guide 45, upper guide 46 and lower guide 47, which each reside within notches 51 extending inwardly from the peripheral edge of the adjustment bracket 50. The adjustment bracket 50 also includes an adjustment screw mounting flange 52 and an adjustment screw 53 extending through an adjustment bracket mounting hole 54 and threaded into screw adjustment flange screw hole 44. A retaining ring 55 is fitted upon the mounting screw 53 to secure its position. Lastly, the adjustment bracket 50 includes four mounting holes 56 extending therethrough and generally in alignment with strap elongated mounting holes 42. Again, the strap assembly also includes a main cover 57 configured to overlay, cover, and/or fit snugly to the strap 31 and cylindrical portion 32 to protect and seal the interior of the strap assembly by substantially covering these portions of the hinge, the term substantially being used to denote that the vast majority of the strap assembly is covered albeit small portions may necessarily extend from the cover to enable the strap assembly to be mounted to the flange assembly. The main cover 57 is formed with a strap portion covering the strap and a cylinder portion covering the cylinder portion 32. The cover strap portion and cover cylinder portion are formed integral with each other, i.e., they are formed as one continuous piece. The main cover In use, the hinge 10 is mounted to the refrigerator or freezer door in the conventional manner as is well known in the art. The mounting flange 16 is secured to the jamb by the use of screws (not shown) that extend through the mounting flange mounting holes 17 and into the jamb. A conventional walk-in refrigerator or freezer door is similarly secured to the hinge 10 by four screws (not shown) that extend through the four mounting holes 17 of the strap assembly adjustment bracket 50 and through the four elongated mounting holes 42 of the strap 31.

Next, the adjustment screw 53 is rotatably threaded into the threaded hole 44 of the screw adjustment flange 43 to cause relative movement between the adjustment bracket 50 and the underlying strap 31. This relative movement causes the movement of the door relative to the stationary jamb, as the elongated holes 42 allow movement of mounting screws and adjustment bracket. The movement of the door enables the door to be properly aligned. The mounting screws are then fully tightened into the door to prevent further movement of the strap. Moreover, should the door sag over time, the mounting screws are slightly loosened and the adjustment screw is merely threaded to once again cause movement of the door to a properly aligned position, as previously described.

Figure 5:
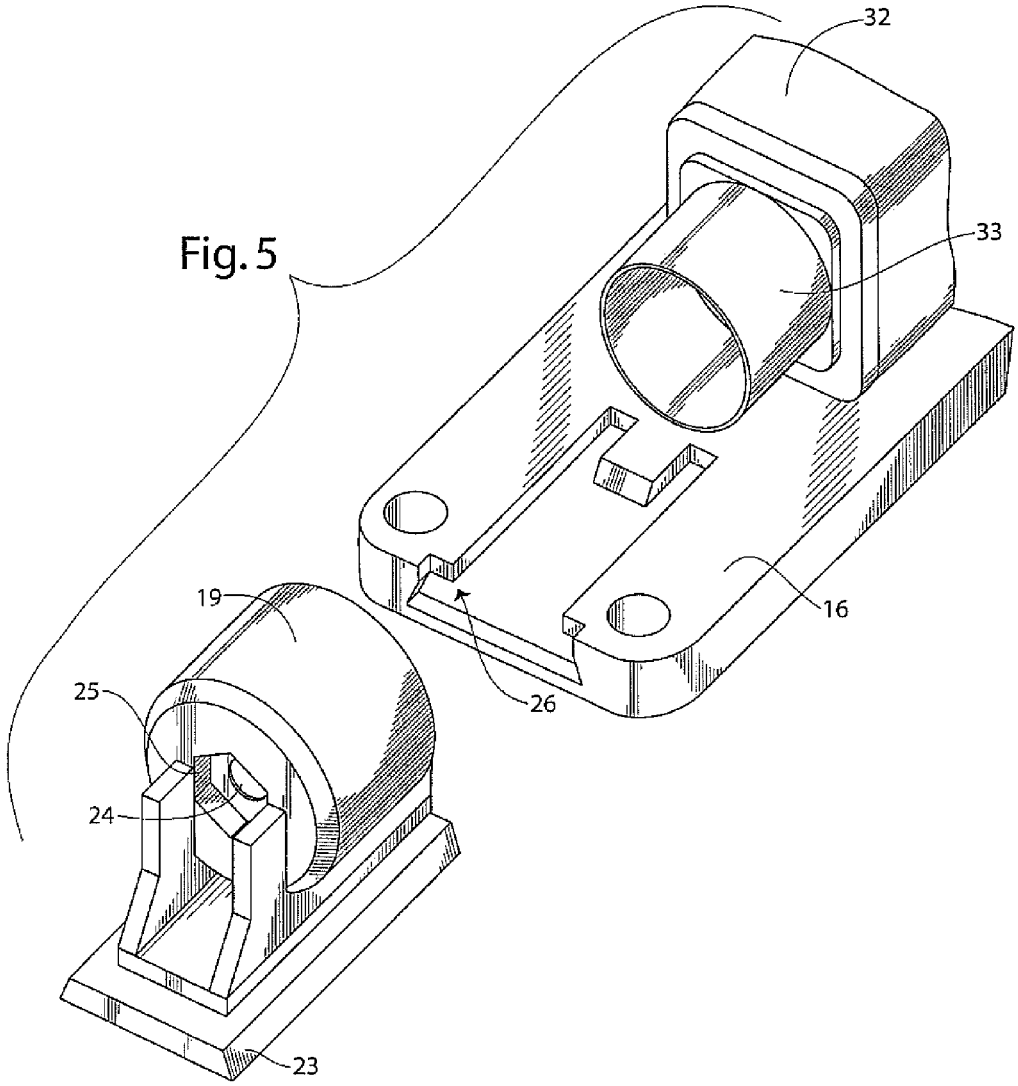
FIG. 5 is a front view of the anti-sag hinge of FIG. 1, shown with the upper hinge barrel lifted from its mounted position to a removed position.

To remove the door from the jamb, the covers 28, 29 and 57 are removed. The hex nut 39 is then unthreaded from the shoulder bolt 38 and the shoulder bolt 38 is lifted and removed. Next, the upper hinge barrel 19 is lifted so that the dove-tail flange 23 is slides upwardly and is removed from the tapered slot 26, as shown in FIG. 5. With the upper hinge barrel 19 disengaged from the upper strap bearing 33, the strap assembly 15 may be raised vertically from the flange assembly 12 thereby removing the door from the jamb. As such, it should be understood that the hinge of the present invention has double shear capabilities or construction, yet it is configured to enable one to lift the door from the jamb.

Thus, the present invention fulfills the need in the art for an apparatus and method for providing a double shear hinge that enables a door to be lifted from and removed from a door jamb. This need is fulfilled by providing an anti-sag hinge for commercial walk-in refrigerator or freezer doors that includes a removably upper hinge barrel.

The present invention also fulfills the need for a cover which enables one to clean the internal components of the hinge easily while providing access to the internal components for ease in disassembling the hinge. The cover is made of a thermally insulative material, such as plastic, to resist condensation of moisture that normally would be associated with metal hinges in such a cold related environment. The removable covers also allow one to colorize the hinge with a personal preference.

It should be understood that the upper hinge barrel may be designed to be removed from the mounting flange in a number of alternative manners, such as with mounting screws, coupling means, locking means, or other similar types of engagement therebetween.

While this invention has been described in detail with particular reference to the preferred embodiments thereof and the best mode of practicing same, it will be understood that variations and modifications can be effected within the spirit and scope of the invention as described herein above and as set forth in the appended claims.

The invention claimed is:

1. A hinge for mounting a door to a door jamb comprising:

a flange assembly having a lower hinge barrel and an upper hinge barrel;

a strap assembly pivotally coupled to said flange assembly, said strap assembly including a horizontally extending elongated strap and a vertically extending cylinder portion coupled to one end of said elongated strap, said cylinder portion being coupled to said flange assembly; and a main cover removably mounted to said strap assembly, said main cover having a horizontally extending elongated first portion overlaying said strap and a vertically extending second portion extending from said first portion overlaying said cylinder portion, and an upper flange cover adapted to be removably mounted to said upper hinge barrel.

2. A hinge for mounting a door to a door iamb comprising:

a flange assembly including a lower hinge barrel and an upper hinge barrel;

a strap assembly pivotally coupled to said flange assembly, said strap assembly including a horizontally extending elongated strap and a vertically extending cylinder portion coupled to one end of said elongated strap, said cylinder portion being coupled to said flange assembly; and a main cover removably mounted to said strap assembly, said main cover having a horizontally extending elongated first portion overlaying said strap and a vertically extending second portion extending from said first portion overlaying said cylinder portion, and a lower flange cover adapted to be removably mounted to said lower hinge barrel.

3. The hinge of claim 2 further comprising an upper flange cover adapted to be removably mounted to said upper hinge barrel.

4. A hinge cover for a hinge for mounting a door to a door jamb, said hinge having a flange assembly including a lower hinge barrel and an upper hinge barrel, a horizontally extending strap, and a vertically extending cylinder portion coupled to said strap, said cylinder portion being coupled to said flange assembly; the cover comprising a horizontally extending elongated cover strap portion overlaying the hinge strap and a vertically extending elongated cover cylinder portion extending from said cover strap portion and overlaying the hinge cylinder portion, and said hinge cover including an upper flange cover adapted to be removably mounted to said upper hinge barrel.

5. The hinge cover of claim 4 wherein said hinge cover is made of a thermally insulative material.

6. The hinge cover of claim 5 wherein said thermally insulative material is made of a plastic material.

7. The hinge cover of claim 4 wherein said strap and said cylinder portion are integral.

8. A hinge cover for a hinge for mounting a door to a door jamb, said hinge having a flange assembly including a lower hinge barrel and an upper hinge barrel, a horizontally extending strap, and a vertically extending cylinder portion coupled to said strap, said cylinder portion being coupled to said flange assembly; the cover comprising a horizontally extending elongated cover strap portion overlaying the hinge strap and a vertically extending elongated cover cylinder portion extending from said cover strap portion and overlaying the hinge cylinder portion, and wherein said hinge cover further includes a lower flange cover adapted to be removably mounted to said lower hinge barrel.

9. The hinge cover of claim 8 further comprising an upper flange cover adapted to be removably mounted to said upper hinge barrel.

10. A hinge for doors being suited from mating engagement with an associated cabinet or jamb, the hinge comprising:

a mounting flange adapted to be mounted to a jamb, said mounting flange having a plurality of screw openings there through;

an upper hinge barrel mounted to said flange;

a lower hinge barrel mounted to said flange;

a strap assembly adapted to be mounted to a door and pivotally coupled to said mounting flange, said strap assembly having a horizontally extending elongated strap with a plurality of screw openings there through and a vertically extending cylinder portion coupled to one end of said strap and removable coupled to said upper hinge barrel, a main cover configured to be removably mounted to said strap assembly with said mounting flange and strap assembly in an installed position upon the door and door jamb, said main cover having a horizontally extending elongated first portion covering said elongated strap and a vertically extending second portion extending from said first portion and covering said cylinder portion, and a first flange cover adapted to be removably mounted to said upper hinge barrel.

11. The hinge of claim 10 wherein said main cover is made of a thermally insulative material.

12. The hinge of claim 11 wherein said thermally insulative material is made of a plastic material.

13. A hinge for doors being suited from mating engagement with an associated cabinet or jamb, the hinge comprising:

a mounting flange adapted to be mounted to a jamb, said mounting flange having a plurality of screw openings there through;

an upper hinge barrel mounted to said flange;

a lower hinge barrel mounted to said flange;

a strap assembly adapted to be mounted to a door and pivotally coupled to said mounting flange, said strap assembly having a horizontally extending elongated strap with a plurality of screw openings there through and a vertically extending cylinder portion coupled to one end of said strap and removable coupled to said upper hinge barrel, a main cover configured to be removably mounted to said strap assembly with said mounting flange and strap assembly in an installed position upon the door and door iamb, said main cover having a horizontally extending elongated first portion covering said elongated strap and a vertically extending second portion extending from said first portion and covering said cylinder portion, and first a flange cover adapted to be removably mounted to said lower hinge barrel.

14. The hinge of claim 13 further comprising a second flange cover adapted to be removably mounted to said upper hinge barrel.

* * * * *